US007118650B2

(12) United States Patent
Inoue

(10) Patent No.: US 7,118,650 B2
(45) Date of Patent: Oct. 10, 2006

(54) WET PAPER WEB TRANSFER BELT

(75) Inventor: Kenji Inoue, Ibaraki-ken (JP)

(73) Assignee: Ichikawa Co., Ltd., Tokyo (JP)

( * ) Notice: Subject to any disclaimer, the term of this patent is extended or adjusted under 35 U.S.C. 154(b) by 126 days.

(21) Appl. No.: 10/764,618

(22) Filed: Jan. 26, 2004

(65) Prior Publication Data

US 2004/0154776 A1 Aug. 12, 2004

(30) Foreign Application Priority Data

Jan. 29, 2003 (JP) ..... 2003-020471

(51) Int. Cl.
*D21F 3/04* (2006.01)

(52) U.S. Cl. ..... 162/358.1; 162/306; 162/358.2; 162/358.4; 162/901; 428/297.4; 442/227

(58) Field of Classification Search ..... 162/116, 162/117, 205–207, 306, 348, 358.2, 358.4, 162/361, 362, 900–904; 442/76, 226, 227; 428/292.1, 297.4, 304.4, 364, 400
See application file for complete search history.

(56) References Cited

U.S. PATENT DOCUMENTS 4,565,735 A * 1/1986 Murka et al. ..... 442/324
4,701,368 A * 10/1987 Kiuchi et al. ..... 442/226
4,799,998 A * 1/1989 Dutt ..... 162/348
5,298,124 A * 3/1994 Eklund et al. ..... 162/306
6,319,365 B1 * 11/2001 Inoue ..... 162/306
6,383,339 B1 * 5/2002 Gstrein ..... 162/358.4
6,465,074 B1 * 10/2002 FitzPatrick et al. ..... 428/131
6,605,188 B1 * 8/2003 Hagfors et al. ..... 162/306
6,616,814 B1 * 9/2003 Best ..... 162/358.4
2004/0065528 A1 * 4/2004 Inoue ..... 198/699.1

FOREIGN PATENT DOCUMENTS

JP 3264461 12/2001

* cited by examiner

*Primary Examiner*—Eric Hug
(74) *Attorney, Agent, or Firm*—Howson and Howson

(57) ABSTRACT

In a wet paper web transfer belt, the wet paper web side layer is formed by a high molecular weight elastic section containing porous bodies which are exposed at, or protrude from the web-contacting surface. The porous bodies are anchored in the resin and wear at about the same rate way as the surrounding resin. Therefore, the distribution of the porous bodies does not vary significantly as a result of abrasion. This transfer belt can transport an attached wet paper web, and release the web smoothly to a next stage in the paper-making process, over a long period of use.

8 Claims, 7 Drawing Sheets

PRIOR ART

WET PAPER WEB TRANSFER BELT

FIELD OF THE INVENTION

This invention relates to wet paper web transfer belts, and particularly, to a belt for transferring a wet paper web at high speed.

BACKGROUND OF THE INVENTION

In recent years, the "closed draw" papermaking machine has been developed for achieving higher speed operation of a papermaking machine. In contrast with the conventional open draw machine, in which a wet paper web is transferred without being supported, in the closed draw machine, the wet paper web is supported throughout the papermaking process. The closed draw structure solves various problems encountered in the operation of the open draw machines, such as running out of paper. Thus, higher speed production can be achieved.

In a typical closed draw papermaking machine, as depicted schematically in FIG. 9, a wet paper web WW, shown by a broken line, which is transferred from right to left in the figure, is supported by press felts PF1 and PF2, a wet paper web transfer belt TB, and a dryer fabric DF. The press felts PF1 and PF2, the wet paper web transfer belt TB, and the dryer fabric DF, are endless belts supported by guide rollers GR.

The wet paper web WW passes through a press part comprising a press roll PR, a concave shoe PS, which conforms to the shape of the press roll, and a shoe press belt SB. The wet paper web then moves past a suction roll SR. The press part and the suction roll structures are generally known.

In the operation of the closed draw machine, a continuous wet paper web WW passes successively through a wire part and a first press part. (The wire part and the first press part are not illustrated.) The wet web is carried from the first press part on press felt PF1, and is then transferred to press felt PF2, as shown in FIG. 9. The press felt PF2 transfers the wet paper web to the press part PP. The wet paper web WW is pinched between by the press felt PF2 and the wet paper web transfer belt TB by the pressure applied by the press roll PR, and by the shoe PS through the shoe press belt SB.

The press felt PF2 has high water permeability and the wet paper web transfer belt TB has low water permeability. Consequently, water in the wet paper web WW moves to the press felt PF2 at the press part PP.

Immediately after the press felt PF2, the wet paper web WW, and the wet paper web transfer belt TB move out of the press part, the pressure on them is suddenly released, and they expand in volume. This expansion, together with the capillary action of the pulp fibers forming the wet paper web WW, causes a rewetting phenomenon wherein part of water in the press felt PF2 moves back into to the wet paper web WW. However, since the wet paper web transfer belt TB has very low permeability, it does not hold water. Therefore, rewetting from the wet paper web transfer belt TB does not occur, and the transfer belt TB contributes to improvement in the efficiency of water removal from the wet paper web.

After the wet paper web WW moves out of the press part PP, it is transferred by the transfer belt TB to the suction roll SR, where the wet paper web is transferred to dryer fabric DF which carries the web through a drying process.

There are several requirements for the proper operation of the wet paper web transfer belt TB. For transfer, the wet paper web WW must be attached to the transfer belt TB, during transport, after the belt moves out of the press part PP. However, the wet paper web WW must be removable from the transfer belt TB smoothly when the web is transferred to the next stage of the papermaking process.

Various transfer belt structures have been proposed for meeting these requirements. Among them, is belt structure of FIG. 10, which is described at pages 7 and 10–13, and shown in FIG. 4, of Japanese Patent No. 3264461. In FIG. 10, the wet paper web transfer belt TB10 comprises a woven fabric 31, a high molecular weight elastic section 51 formed on one side of the woven fabric, and a batt layer 41 formed on the other side of the woven fabric. The wet paper web side layer TB11 of belt TB10 is formed by the high molecular weight elastic section 51 and the machine side layer TB12 is formed by the batt layer 41.

The exposed surface of the wet paper web side layer TB11 is roughened by grinding. The ten-point average surface roughness Rz (according to JIS-B0601) is in the range of 0 to 20 microns while the belt is in the press part, and in the range of 2 to 80 microns after the belt moves out of the press part.

The ten-point average roughness Rz, in the range of 0 to 20 microns in the press part is maintained for a short time after the belt moves out of the press part. In other words, the surface of the wet paper web side layer TB11 is smooth at this point. Therefore, a thin film of water may be formed between the wet paper web and the smooth surface of the wet paper web side layer TB11. The thin film of water causes the wet paper web to adhere to the surface of the wet paper web side layer TB11.

As the transfer belt TB10 travels away from the press part, the ten-point average surface roughness of its wet paper web side layer TB11, increases to a level within the range from 2 to 80 microns. The increase in the surface roughness of layer TB11, breaks the thin water film, reducing the adhesion between the transfer belt and the wet paper web. Therefore, the wet paper web can be more easily transferred from the belt TB10 to the next stage of the papermaking process.

The transfer belt shown in FIG. 10 meets the requirements described above for the proper operation of a wet paper web transfer belt by continually changing its surface roughness as it passes through the press part of the papermaking machine. However, in use the wet paper web side layer TB11 becomes worn, and the desirable effects resulting from the changing surface roughness of the belt diminish. Consequently, the belt becomes increasingly difficult to use over time.

To address this deficiency in the belt of FIG. 10, Japanese Patent No. 3264461 discloses an alternative transfer belt structure, as shown in FIG. 11, in which particles 60 of a filler protrude from the surface on the wet paper web side layer TB11. For the purpose of illustration, the size of the filler particles is exaggerated in FIG. 11, since the actual particle size is in the order of a micron. The protruding filler particles 60 contribute to breaking of the thin water film. Moreover, the use of a hydrophilic filler makes it possible for the thin water film which is formed after the belt moves out of the nip of the press part to concentrate at the locations of the protruding filler bodies 60 and thus be destroyed.

Kaolin clay (hydrous silicic acid aluminum, having the general chemical formula $Al_2O_3.2SiO_2.2H_2O$) is used for the filler.

Because the surface of the wet paper web side layer TB11of the transfer belt is relatively smooth, there is a high likelihood that some filler bodies will separate from the surface of the belt, either during manufacture of the belt or during its use in the papermaking process. In the manufacturing process, the filler which is mixed with liquefied high molecular weight elastic material, and the mixture is applied to a woven cloth 31 and then cured. After curing, the surface of the wet paper web side layer TB11 is ground, and in the grinding process some of the filler is scooped out. Filler can also separate from the belt in the papermaking process due to the high operating speeds and the strain in the belt resulting from the application of pressure in the press part of the machine. Because of the loss of filler, it has been difficult to obtain uniform physical properties in a transfer belt, and adequate durability. Thus it was difficult to produce a wet paper web transfer belt suitable for use over a long time.

An object of this invention, therefore, is to provide a wet paper web transfer belt which can be used for a long time, while fully meeting the requirements for attachment of the wet paper web to the belt during transport, and smooth removal of the wet paper web from the belt when the web is transferred to a next stage in the papermaking process.

SUMMARY OF THE INVENTION

In accordance with the invention, a wet paper web transfer belt, for use in the press part of a closed draw papermaking machine, comprises comprising a base body, a machine side layer, and a wet paper web side layer, the wet paper web side layer having a wet paper web contacting surface and having porous bodies embedded therein. A plurality of the porous bodies, which may be constituted by a porous filler, or by porous fibers, are exposed at the wet paper web contacting surface. Especially in the case in which the porous bodies are in the form of porous fiber, the porous bodies can protrude from the wet paper web side layer of the belt.

The porous bodes resist falling off the belt because they are well-anchored in the wet web side layer, which is preferably composed of a mixture of the porous bodies in a high molecular weight elastic material such as urethane resin. The transfer belt can transport an attached wet paper web, and release the web smoothly to a next stage in the papermaking process, over a long period of use.

BRIEF DESCRIPTION OF THE DRAWINGS

FIG. 1(*b*) is a cross-sectional schematic view, taken in the cross machine direction, of a second embodiment of wet paper web transfer belt according to the invention;

FIG. 2(*b*) is an enlarged oblique view of a porous fiber for use in the belt of FIG. 2;

DETAILED DESCRIPTION OF THE PREFERRED EMBODIMENTS

Figure 1A:
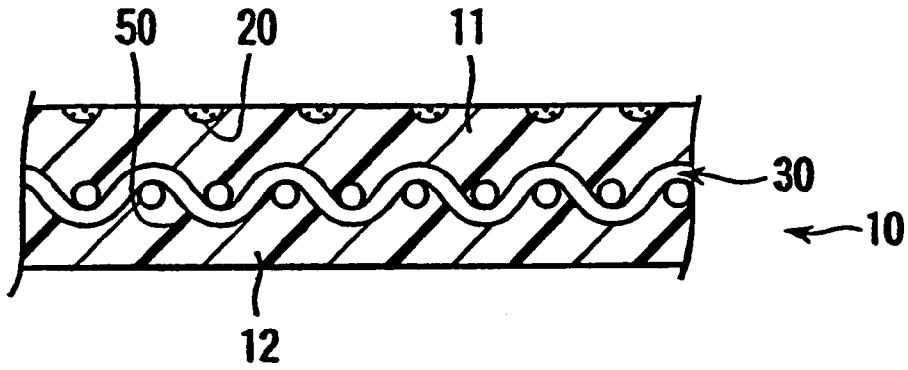
FIG. 1(*a*) is a cross-sectional schematic view, taken in the cross machine direction, of first embodiment of a wet paper web transfer belt according to the invention.
Figure 1B:
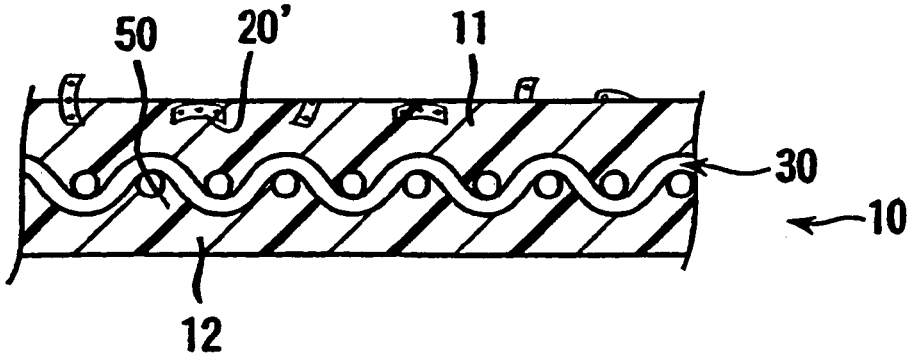
Figure 2A:
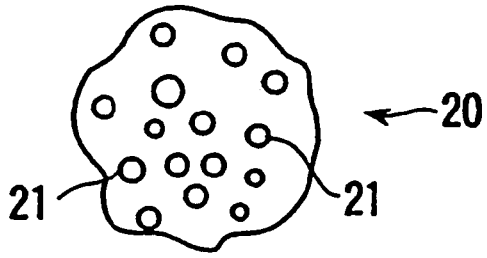
FIG. 2(*a*) is an enlarged view of a porous particle for use in the belt of FIG. 1.
Figure 2B:
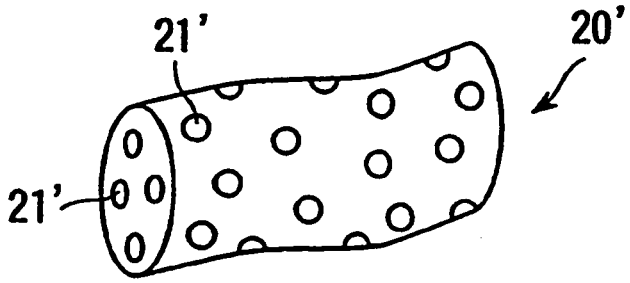

Each of the wet paper web transfer belts 10 of FIGS. 1(*a*) and 1(*b*) comprises a base body 30, a wet paper web side layer 11 and a machine side layer 12. The wet paper web side layer 11 is formed by a high molecular weight elastic material 50. In FIG. 1(*a*), porous bodies 20, are in the form of particles, as shown in detail in FIG. 2(*a*). These porous bodies are exposed at the surface of the wet paper web side layer 11. In FIG. 1(*b*) the porous bodies are in the form of porous fibers 20', as shown in detail in FIG. 2(*b*). Some of these porous fibers 20' are exposed at the surface of the wet paper web side layer 11 and some of the porous fibers 20' protrude from the surface of the layer 11.

The high molecular weight elastic material enters the pores of the porous bodies 20 and 20', thereby achieving a greater contact area between the elastic material and the bodies that in the case of non-porous bodies. Because the high molecular weight elastic material enters the pores of the bodies, and because of the greater contact area, the exposed and protruding bodies are firmly anchored in the wet paper web side layer 11. Thus, unlike an ordinary filler such as kaolin, etc., which tends to fall off by itself during use even without being worn away, the porous bodies 20 and 20' tend to wear during use in the same way as the surrounding resin as a result of friction and abrasion. The distribution of the exposed porous bodies does not change as a result of abrasion during use.

A wet paper web transfer belt of the invention may be produced by mixing the porous bodies into a high molecular weight elastic material, forming the wet web side layer of a belt from the mixture, and then grinding the surface of the wet web side layer, and thereby either exposing porous bodies or causing them to protrude from the surface of the belt.

In an alternative manufacturing method, porous fibers are intertwined with the outer surface of a base body by a process such as needle punching. A high molecular weight elastic material is then laid onto the porous fiber layer, forming a wet web side layer composed of porous fibers impregnated with the elastic material. Thereafter, the outer surface of the wet web side layer is ground to expose some of the porous fibers or to cause some of the fibers to protrude.

Figure 3:
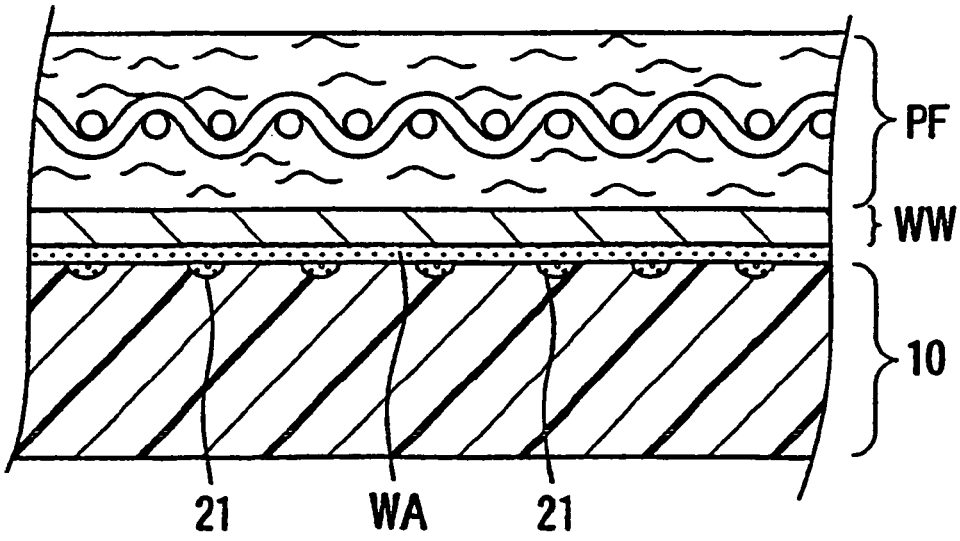
FIG. 3 is a first cross-sectional view illustrating the operation of a wet paper web transfer belt according to the invention.

In FIG. 3, which is a cross-sectional view taken at the press part of a papermaking machine, a press felt PF, a wet paper web WW and a wet paper web transfer belt 10 are shown. The wet paper web WW is pinched between the press felt PF and the belt 10. At the press part, most of the water from the wet paper web moves to the press felt PF, since the permeability of the wet paper web transfer belt 10 is either zero or very low. Water WA from the wet paper web WW forms a film between the wet paper web WW and the belt 10.

Figure 4:
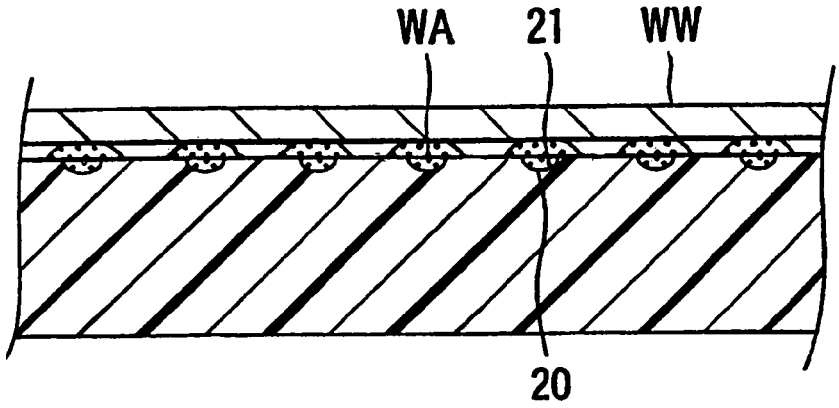
FIG. 4 is a second cross-sectional view illustrating the operation of a wet paper web transfer belt according to the invention.

In FIG. 4, which shows press felt PF, the wet paper web WW, and the wet paper web transfer belt 10 after they have traveled beyond the press part. The porosity of the porous bodies improves their affinity for water, and causes water to concentrate at the locations of the exposed porous bodies. The water between the wet paper web WW and the belt 10 is drawn to the pores 21 of the porous bodies 20 by capillary action, and the water becomes concentrated at the locations of the exposed porous bodies, as shown in FIG. 4.

Porous fibers exhibit the same effect as non-fibrous porous filler bodies. Protruding porous fibers also draw water due to the effect of surface tension.

The water held in the porous bodies 20 enables the wet paper web WW to remain attached to the wet paper web transfer belt 10. However, when the belt 10, carrying the wet paper web WW travels to a next stage in the papermaking process, the web may be transferred smoothly from the belt 10 because the water is concentrated at the locations of the porous bodies and is not in the form of a continuous film, which would cause strong adhesion of the web to the belt. The use of porous bodies in the wet web side layer of the transfer belt enables the transfer belt to satisfy the requirements of adhesion of the wet web to the belt, and smooth release of the wet web from the belt, without depending on surface roughness of the high molecular weight elastic material which forms the wet paper web side layer.

The size of the porous bodies 20 is preferably such that a rectangle, having the minimum area required to surround the pores of a porous body, has a larger side less than 10μm in length. This length is shorter than an average pulp fiber in a wet paper web. By maintaining the sizes of the porous bodies within this dimensional limit, the possibility of clogging is reduced, and the beneficial effects of the porous bodies 20 can be realized over a long term of operation.

Because the pores 21 are smaller than the average interval between pulp fibers in a wet paper web, water held in the pores 21 does not move back into to the wet paper web WW by capillary action immediately after the wet paper web moves out of the press part. Therefore, the porous bodies do not cause re-wetting.

The area ratio of the exposed parts of the porous bodies 20 to the surface of the belt is preferably in the range from 5% to 50%. A ratio below 5% makes it difficult to remove the wet paper web from the wet paper web transfer belt, and a ratio above 50% causes the belt to lose its flexibility so that it no longer functions properly as a belt. The area ratio may be easily measured by photographing the surface of the belt with an electron microscope, scanning the picture into a computer, clarifying the picture using picture reading software such as "Photoshop5" from Adobe System Incorporated, and then calculating the areas of the porous bodies by the use of image processing software such as "NIH image" from the National Institutes of Health.

In the case of a porous filler, a porous body 20 having an average body diameter from 5 μm to 500 μm may be used. The porous filler may be inorganic or organic, and may be hydrophilic or hydrophobic.

Diatomaceous earth (silicic acid: biolite, which contains more than 80% $SiO_2$) may be used as an inorganic porous filler. This product is available on the market as "RADIOLITE FINE FLOW B", a trademark of Showa Chemical Industry Co., Ltd. A high functional acrylic fiber may be used as an organic porous fiber. This product is available on the market as "BIOSAFE", a trademark of Kanebo Synthetic Fiber Co., Ltd.

The porosity of the porous body is preferably around 90% for a porous filler and 60% for a porous fiber. Porosity is calculated using the formula:

$$\text{Porosity}=[1-W_1/P\ (W_3-W_2)]\times 100\%$$

where:

$W_1$ is the weight of a dried sample;

$W_2$ is the weight of a sample which absorbs water and is suspended underwater;

$W_3$ is the weight of a sample which absorbs water; and

P is the true density.

Specific examples of wet paper web transfer belts according to the invention will be explained, with reference to FIGS. 5–7.

Figure 5:
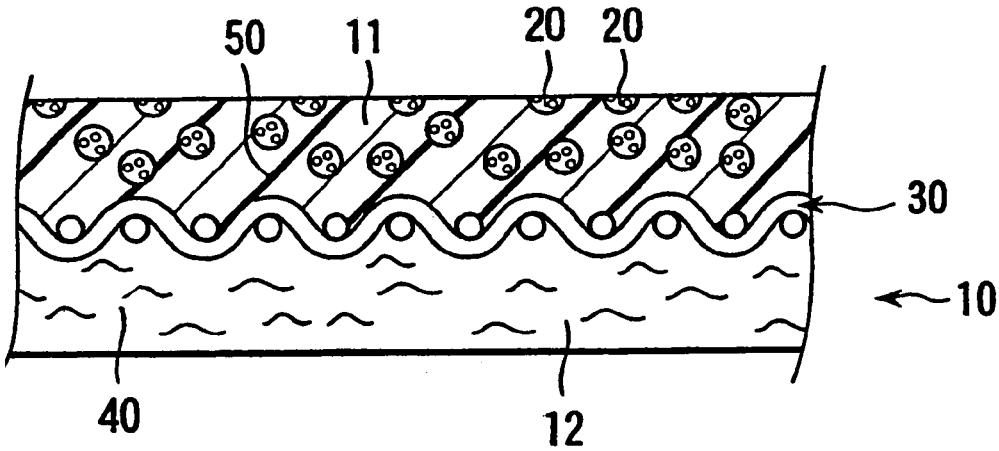
FIG. 5 is a cross-sectional view of a wet paper web transfer belt in accordance with an embodiment of the invention.

The wet paper web transfer belt 10 in FIG. 5 comprises a base body 30, a batt layer 40 comprising a batt fiber intertwiningly integrated with one side of the base body 30, and a high molecular weight elastic section 50 formed on the other side of the base body 30. The high molecular weight elastic section 50 constitutes the wet paper web side layer 11, and the batt layer 40 constitutes the machine side layer 12.

Numerous porous bodies 20 are exposed on the surface of the wet paper web side layer 11. The wet paper web side layer 11 may be obtained by mixing porous bodies 20 with liquid, high molecular weight, elastic material used to form the high molecular weight elastic section 50. After curing the high molecular weight elastic material containing the porous bodies 20, porous bodies are exposed by grinding the surface of the wet paper web side layer 11 with sandpaper, a whetstone, or the like.

In FIG. 5, the machine side layer of the wet paper web transfer belt 10 comprises only batt fiber 40. However, a high molecular weight elastic material may be impregnated into this batt fiber 40 as shown in FIG. 6.

Figure 7:
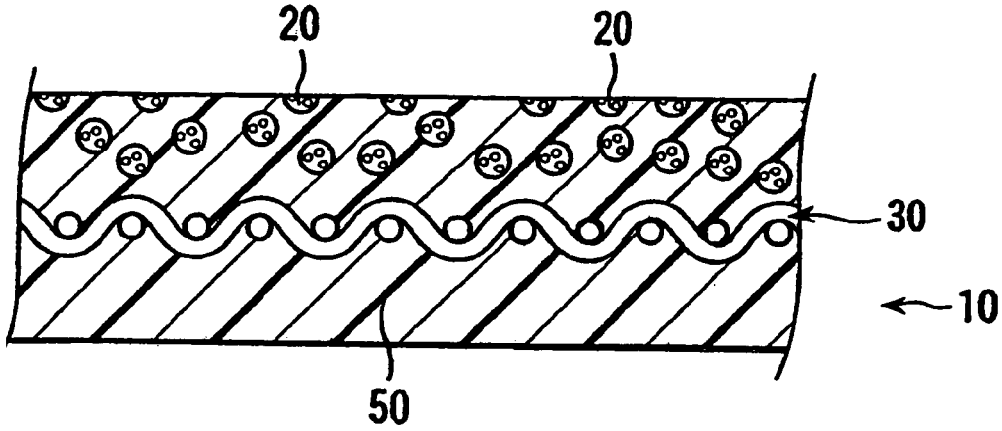
FIG. 7 is a cross-sectional view of a wet paper web transfer belt of still another embodiment according to the invention.

Moreover, the machine side layer may be composed entirely of a high molecular weight elastic material 50 as shown in FIG. 7, so that the transfer belt is formed without a batt fiber layer. In other words, it is sufficient for a wet paper web transfer belt 10 according to the invention that it include a wet paper web side layer 11 comprising a high molecular weight elastic section and porous bodies exposed on the surface of the wet paper web side layer 11.

Figure 6:
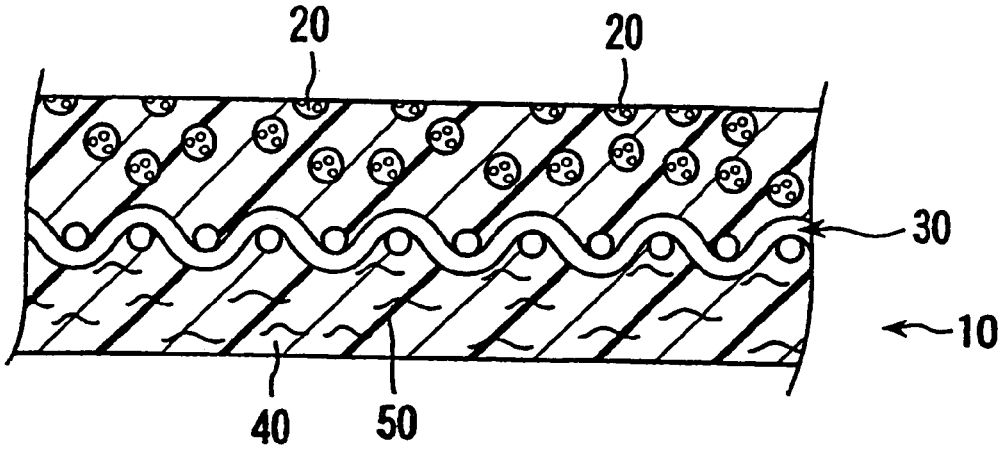
FIG. 6 is a cross-sectional view of a wet paper web transfer belt of another embodiment according to the invention.

In each of the cases illustrated in FIGS. 5–7, the porous bodies 20 are exposed by grinding the surface of the wet paper web side layer 11.

The wet paper web side layer 11 of a wet paper web transfer belt 10 according to the invention contributes to the formation of an excellent paper surface since its web-contacting surface is smoother than the web-contacting surface of a press felt.

A thermosetting urethane resin or the like may be used as the material of the high molecular weight elastic section 50, and its Shore A hardness is desirably between 50 and 95.

In general, it is satisfactory if the wet paper web transfer belt according to the invention has no permeability. On the other hand, some papermaking machines requires a transfer belt having permeability. In such a case, the desired belt structure may be obtained by reducing the amount of the impregnated high molecular weight elastic material, increasing the amount of grinding, or using a high molecular weight elastic material having open cells. However, even in the case of a belt having some permeability case, the permeability of the belt is preferably 2 $cc/cm^2/sec$ or less, measured by the test method for general woven fabric specified in JIS L 1096, using a fragile type testing machine.

The base body 30 imparts strength to the wet paper web transfer belt. While a fabric woven with machine direction yarns and cross machine direction yarns is shown in FIGS. 5–7, the base body is not limited to this structure, and may have various alternative structures as appropriate, such as, yarns in the machine direction and the cross machine direction which are overlapping rather than woven, or may be in the form of a film a knitted structure, or a wide belt-shaped body made by winding a narrow belt-shaped body in a helix.

EXAMPLE 1

A wet paper web transfer belt according to the invention, having the structure shown in FIG. 5 was produced in the following process.

An endless double woven fabric was obtained by weaving machine direction yarns and cross machine direction yarns of nylon-6 so that the basis weight of the double woven fabric was 600 g/m$^2$. Staple fiber comprising nylon-6 and having an average fineness of 20 dtex was intertwiningly integrated with the outer surface of an endless woven fabric by needle punching. The basis weight of the staple fiber layer was 200g/m$^2$.

The fabric was then turned over, and the side which was not previously intertwiningly integrated with staple fiber became a new outer surface. To form the batt layer, staple fiber having an average fineness of 20 dtex was then intertwiningly integrated with the new outer surface by needle punching so that the basis weight of the staple fiber layer 200 g/m$^2$. Thus, a belt having a batt with a basis weight of 200 g/m$^2$ on both sides was formed.

One side of the structure was then coated with urethane resin containing a RADIOLITE FINE FLOW B as a porous filler. The porous filler was present in the mixture in an amount equal to 30% by weight relative to 100% by weight of the urethane resin was mixed. Moreover, the average diameter of the porous bodies was 13.7 μm. The porosity of the porous bodies was 90%, and the main component of the porous material was $SiO_2$.

After curing the urethane resin, the outer surface was ground to a ten-point average surface roughness Rz of 15 μm. The grinding process exposed porous bodies on the surface of the resin layer, and completed the wet paper web transfer belt.

EXAMPLE 2

Another wet paper web transfer belt according to the invention was produced by the following process.

An endless double woven fabric was obtained by weaving machine direction yarns and cross machine direction yarns of nylon-6 so that the basis weight of the double woven fabric was 600 g/m$^2$. Staple fiber comprising nylon-6 and having an average fineness of 20 dtex was intertwiningly integrated with the outer surface of an endless woven fabric by needle punching. The basis weight of the staple fiber layer was 200 g/m$^2$.

The fabric was then turned over, and the side which was not previously intertwiningly integrated with staple fiber became a new outer surface. A multilayer BIOSAFE staple fiber having an average fineness of 3.3 dtex an average length of 76 mm, and a porosity of 60%, was intertwiningly integrated with the new outer surface of the woven fabric by needle punching so that the basis weight of the latter staple fiber layer 300 g/m$^2$. Thus, a belt in which basis weight of an inside batt was 200 g/m$^2$, and the basis weight of an outer side batt was 300 g/m$^2$, was obtained. The BIOSAFE staple fiber layer was pressed to make its density 0.4 g/cm$^3$.

The outer surface of the woven fabric was then impregnated with urethane resin and cured.

After curing the urethane resin, the outer surface was ground to a ten-point average roughness Rz of 35 μm. The grinding process exposes porous bodies on the surface of the resin layer, and completed the wet paper web transfer belt.

Comparative Example

Figure 11:
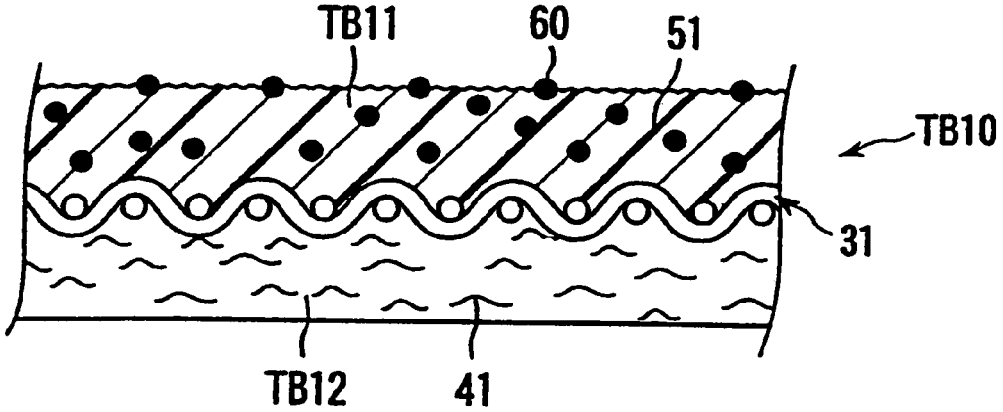
FIG. 11 PRIOR ART
FIG. 11 is a cross-sectional view of another conventional wet paper web transfer belt.

As a comparative example, the structure shown in FIG. 11 was produced in the following process.

An endless double woven fabric was obtained by weaving machine direction yarns and cross machine direction yarns of nylon-6 so that the basis weight of the double woven fabric was 600 g/m$^2$. Staple fiber comprising nylon-6 and having an average fineness of 20 dtex was intertwiningly integrated with the outer surface of an endless woven fabric by needle punching. The basis weight of the staple fiber layer was 200 g/m$^2$.

The fabric was then turned over, and the side which was not previously intertwiningly integrated with staple fiber became a new outer surface. To form the batt layer, staple fiber having an average fineness of 20 dtex was then intertwiningly integrated with the new outer surface by needle punching so that the basis weight of the staple fiber layer 200 g/m$^2$. Thus, a belt having a batt with a basis weight of 200 g/m$^2$ on both sides was formed.

A mixture of kaolin clay and urethane resin, containing 40% by weight of kaolin clay relative to 100% by weight of urethane resin, was coated over the outer surface of the woven fabric. The average diameter of the kaolin clay particles was 9.5 μm, and their porosity was 20%.

After curing the urethane resin, the outer surface was ground to a ten-point average roughness Rz of 15μm. This process caused kaolin clay to protrude from the surface of resin and completed the wet paper web transfer belt.

Figure 8:
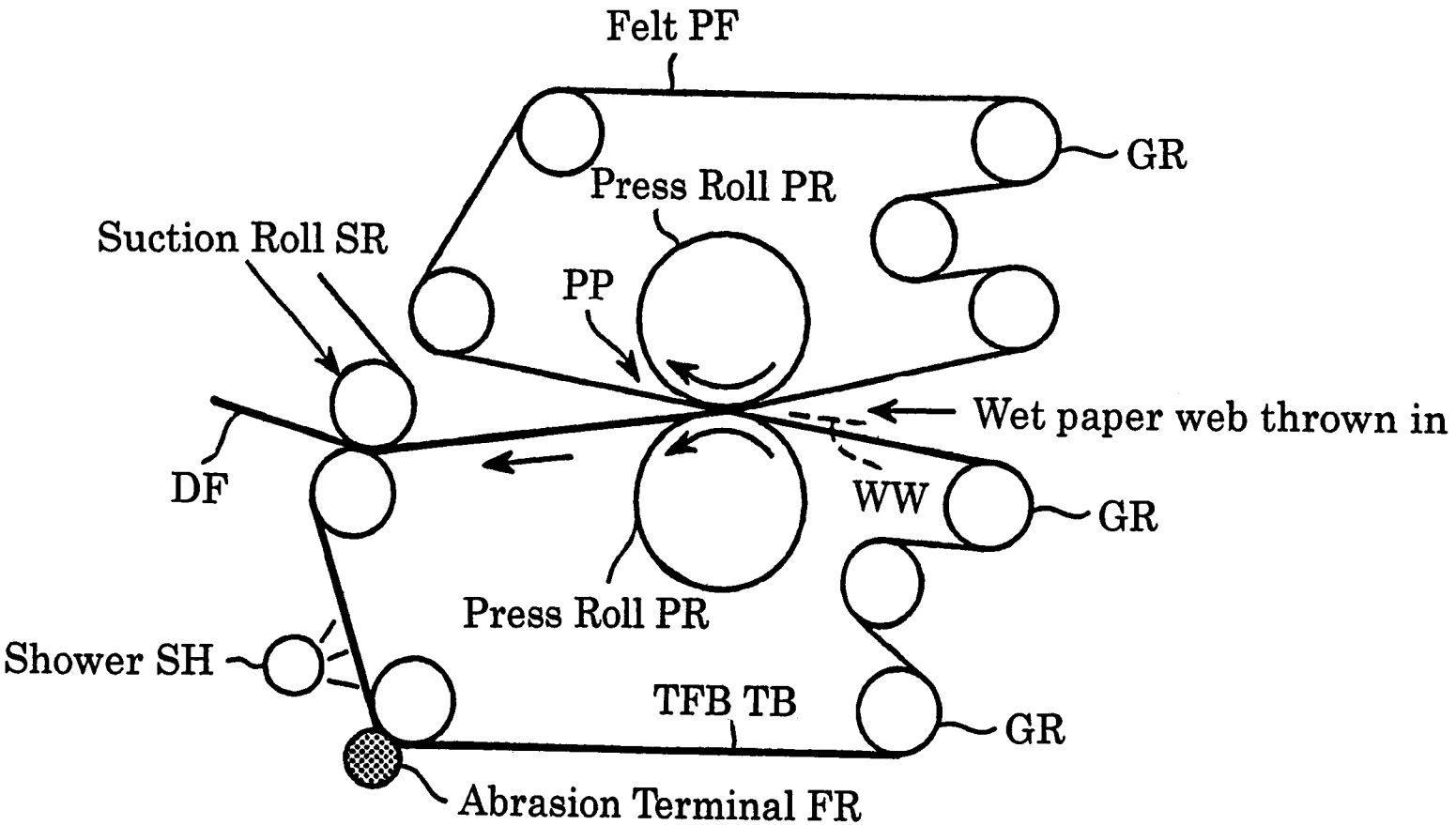
FIG. 8 is a schematic view of an apparatus for evaluating the functional durability of wet paper web transfer belts.
Figure 9:
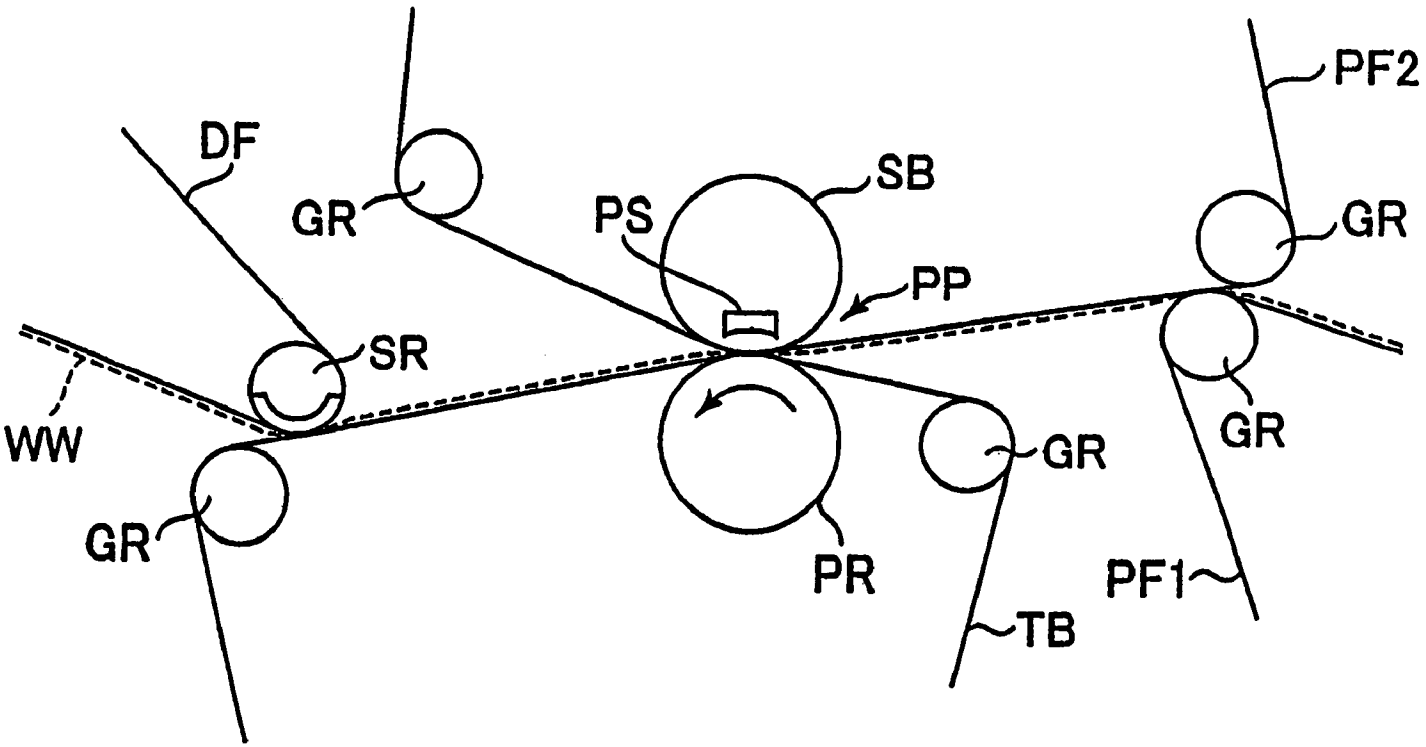
FIG. 9 is a schematic view of a typical closed draw papermaking machine.
Figure 10:
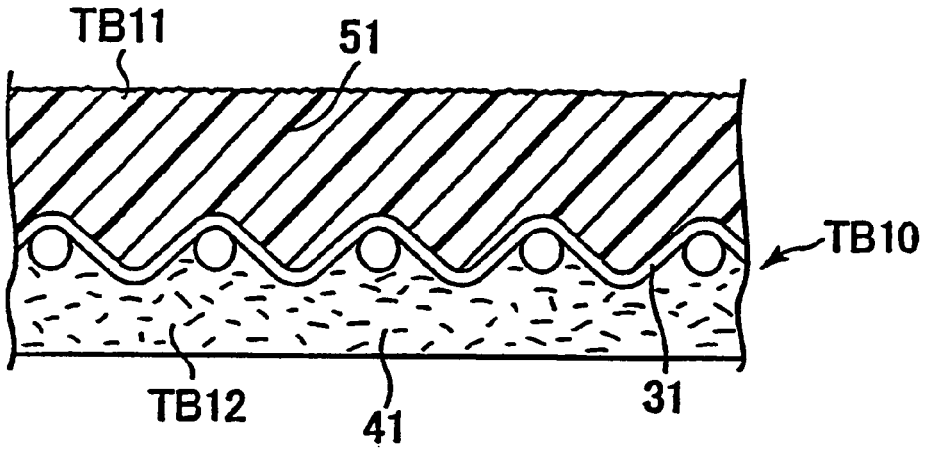
FIG. 10 PRIOR ART
FIG. 10 is a cross-sectional view of a conventional wet paper web transfer belt.

Tests of the three wet paper web transfer belts were conducted by using an apparatus as shown in FIG. 8.

This experimental apparatus comprises a pair of press rolls PR forming a press part PP, a press felt PF pinched by the press rolls, and a wet paper web transfer belt TB. The press felt PF and the wet paper web transfer belt TB were supported under a predetermined tension by a plurality of guide rolls GR, and moved along with the rotation of the press rolls PR.

SR is a suction roll and DF is a dryer fabric in FIG. 8. While only a part of a dryer fabric DF is shown, the dryer fabric is endless, and is supported by guide rolls GR and driven by the wet paper web transfer belt TB.

An abrasion terminal FR, which comprises ultra high molecular weight polyethylene, is pushed against the wet paper web transfer belt TB to accelerate abrasion of the belt TB.

In the operation of the test apparatus, a wet paper web WW was thrown on the wet paper web transfer belt TB on the upstream side relative to the press part PP. The wet paper web WW passed through the press part PP, and was transferred from the transfer belt TB to the dryer fabric DR by the suction roll SR.

The tests were carried out on the wet paper web transfer belts immediately following the production of the belts.

The wet paper transfer belts were run for 30 hours in these tests, and during the tests, the abrasion terminal FR continuously wore the wet paper web transfer belt TB. After the elapse of 30 hours, a wet paper web WW was thrown on the transfer belt TB once again. The test, therefore, compares a new wet paper web transfer belt TB with a worn belt.

The driving speed of the apparatus was 150 m/min, the pressure at the press part was 40 kg/cm, and the vacuum at the suction roll SR was 150 mm Hg. The wet paper web WW was composed of craft pulp, having an average basis weight of 80 g/m$^2$ and a dryness of 38%.

The press felt PF had a conventional structure, comprising a woven fabric and a batt layer which was intertwiningly integrated with the woven fabric by needle punching. The press felt had a basis weight of 1200 g/m$^2$, a batt fiber fineness of 10 dtex, and a felt density 0.45 /cm$^3$.

The results of the tests are shown in the following table.

| | New | | After being run for 30 hours | |
|---|---|---|---|---|
| | Adhesion after being pressed | Transfer to next process | Adhesion after being pressed | Transfer to next process |
| EXAMPLE 1 | good | good | good | good |
| EXAMPLE 2 | good | good | good | good |
| COMPARATIVE EXAMPLE | good | good | good | fail |

As shown in the table, excellent results were obtained from Examples 1–2 in all the tests.

On the other hand, in the case of the comparative example, difficulty was encountered in the transfer of the wet paper web to the dryer fabric DF after the transfer belt was run for 30 hours.

The conditions of the surface of the wet paper web transfer belt when new, and after having been run for 30 hours, were photographed by an electron microscope for each of Examples 1 and 2, and the comparative example. After the belts were run for 30 hours, porous bodies were found in the belts of Examples 1 and 2, but no kaolin clay was found in the belt of the comparative example.

The belt of the comparative example functioned efficiently when new because of the surface roughness resulting from grinding of the surface of the resin and the exposure of the kaolin clay in the manufacturing process. However, after the belt of the comparative example was run for 30 hours, the surface of resin was worn smooth by the abrasion terminal FR, and the kaolin clay fell away. The water film between the belt and the wet paper web WW did not break, and therefore failure occurred in the transfer of the wet paper web WW to the drying stage.

On the other hand, in the case of Examples 1 and 2, because the porous bodies were anchored in the resin the porous bodies did not fall off even after resin was worn. As a result, the belt continued to function efficiently regardless of the condition of the surface roughness of resin. In addition, it was determined from electron microscope photographs that the porous bodies and resin were worn almost at the same rate. Therefore, even after abrasion, excellent results were obtained with the belts of Examples 1 and 2.

In summary, the transfer belt in accordance with the invention is advantageous because the porous bodies are anchored in the resin on the wet paper web side of the belt. The porous bodies resist falling off from the wet paper web side layer. The proper function of the belt, in which the wet paper web remains attached to the belt during transport but can be transferred smoothly to a next stage in the papermaking process, can be maintained over a very long period of time.

What is claimed is:

1. A wet paper web transfer belt, ready for use in the press part of a closed draw papermaking machine, said belt comprising a base body, a machine side layer, and a wet paper web side layer, the wet paper web side layer comprising a high molecular weight elastic material, having a wet paper web contacting surface and fibers embedded in said elastic material, wherein said wet paper web side layer is obtained by mixing said fibers with high molecular weight elastic material, and a plurality of said fibers have portions which are embedded in said elastic material and portions which protrude from said wet paper web contacting surface, said protruding portions of said fibers having pores capable of drawing in water by capillary action.

2. A wet paper web transfer belt as claimed in claim 1, wherein the area ratio of the exposed parts of the porous fibers to said wet paper web contacting surface is in the range from 5% to 50%.

3. A wet paper transfer belt as claimed in claim 1, wherein the porosity of said porous fibers is around 60%.

4. A wet paper web transfer belt as claimed in claim 1, in which the embedded portions of said plurality of fibers also have pores, and in which said plurality of fibers are firmly anchored in the wet paper web side layer by entry of elastic material of said wet paper web side layer into pores of said embedded portions.

5. A closed draw papermaking machine comprising a press part, and a wet paper web transfer belt in said press part arranged to move through said press part, said belt comprising a base body, a machine side layer, and a wet paper web side layer, the wet paper web side layer comprising a high molecular weight elastic material, having a wet paper web contacting surface and fibers embedded in said elastic material, wherein said wet paper web side layer is obtained by mixing said fibers with high molecular weight elastic material, and a plurality of said fibers have portions which are embedded in said elastic material and portions which protrude from said wet paper web contacting surface, said protruding portions of said fibers having pores capable of drawing in water by capillary action.

6. A closed draw papermaking machine as claimed in claim 5, wherein the area ratio of the exposed parts of the porous fibers to said wet taper web contacting surface is in the range from 5% to 50%.

7. A closed draw papermaking machine as claimed in claim 5, wherein the porosity of said porous fibers is around 60%.

8. A closed draw papermaking machine as claimed in claim 5, in which the embedded portions of said plurality of fibers also have pores, and in which said plurality of fibers are firmly anchored in the wet paper web side layer by entry of elastic material of said wet paper web side layer into pores of said embedded portions.

* * * * *